US006948348B2

(12) United States Patent
Wells et al.

(10) Patent No.: US 6,948,348 B2
(45) Date of Patent: Sep. 27, 2005

(54) METHOD OF ARRANGING COILS IN A SPRING COIL ASSEMBLY

(75) Inventors: David Scott Wells, Pleasant Prairie, WI (US); George M. Chembakassery, Kenosha, WI (US); Michael E. Andrea, Kenosha, WI (US)

(73) Assignee: Frank L. Wells Company, Kenosha, WI (US)

( * ) Notice: Subject to any disclaimer, the term of this patent is extended or adjusted under 35 U.S.C. 154(b) by 0 days.

(21) Appl. No.: 10/752,051

(22) Filed: Jan. 5, 2004

(65) Prior Publication Data

US 2004/0159990 A1 Aug. 19, 2004

Related U.S. Application Data

(62) Division of application No. 09/885,300, filed on Jun. 20, 2001, now Pat. No. 6,758,078.

(51) Int. Cl.[7] ..... B21F 3/12
(52) U.S. Cl. ..... 72/134; 72/138
(58) Field of Search ..... 72/134–138

(56) References Cited

U.S. PATENT DOCUMENTS

| | | | | |
|---|---|---|---|---|
| 114,618 | A | 5/1871 | Speckner | |
| 349,310 | A | 9/1886 | Keene | |
| 3,348,583 | A | 10/1967 | Goldmeyer et al. | |
| 3,774,652 | A | 11/1973 | Sturm | |
| 4,236,262 | A | 12/1980 | Spiller | |
| 5,579,810 | A | 12/1996 | Ramsey et al. | |
| 5,934,339 | A | 8/1999 | Ramsey | |
| 5,950,473 | A | 9/1999 | Andrea et al. | |
| 6,324,711 | B1 | 12/2001 | Wells | 5/716 |
| 6,375,169 | B1 | 4/2002 | McCraw et al. | |
| 6,430,982 | B2 | 8/2002 | Andrea et al. | 72/134 |
| 6,758,078 | B2 * | 7/2004 | Wells et al. | 72/134 |

FOREIGN PATENT DOCUMENTS

| | | |
|---|---|---|
| EP | 0899034 | 3/1999 |
| FR | 793155 | 1/1936 |
| FR | 1325945 | 5/1963 |

* cited by examiner

*Primary Examiner*—Matthew C. Graham
(74) *Attorney, Agent, or Firm*—Boyle, Fredrickson, Newholm, Stein & Gratz, S.C.

(57) ABSTRACT

A spring coil assembly having a first row of coils arranged in a first spacing pattern and a second row of coils adjacent the first row and arranged in a second spacing pattern that is different from the first spacing pattern. The spring coil assembly can be assembled using an apparatus comprising a main conveyor adapted to convey a plurality of coils along an axis, an assembler which is operable to intertwine a plurality of coils into a spring coil assembly, and a transfer station operable to move a plurality of coils from the main conveyor into the assembler. The transfer station includes a plurality of pusher arms each of which include a gripper which is operable to grasp an individual coil, a carriage supporting the gripper arms and means for shifting the carriage axially relative to the axis so that a plurality of coils carried by the gripper arms are displaced in the direction of travel of the conveyor.

3 Claims, 10 Drawing Sheets

METHOD OF ARRANGING COILS IN A SPRING COIL ASSEMBLY

CROSS REFERENCE TO RELATED APPLICATION

This application is a divisional of application Ser. No. 09/885,300 filed Jun. 20, 2001 now U.S. Pat. No. 6,758,078.

FIELD OF THE INVENTION

The invention relates to spring coil assemblies, and more particularly to systems for making spring coil assemblies.

BACKGROUND OF THE INVENTION

Spring coil assemblies are well known for use in mattresses, furniture, cushions and the like. In the case of mattresses, it is known, to use two types of coils in constructing the spring coil assembly. The industry commonly designates these two types of coils as right-hand coils and left-hand coils based on the location and orientation of the end wind of the coil. As used herein and in the appended claims, the terms "right-hand coils" and "left-hand coils" are used only by way of example, and different terminology could be substituted.

FIG. 1 shows a typical prior art coil assembly 10. The prior art coil assembly includes a plurality of substantially identical adjacent rows $R_1$, $R_2$, $R_3$ . . . Each row R consists of alternating right-hand (designated both in FIG. 1 and in the other drawings as RH) and left-hand (designated as LH) coils. The plurality of adjacent rows forms a plurality of adjacent columns $C_1$, $C_2$, $C_3$ . . . Each column C consists entirely of all right-hand coils or all left-hand coils. To remain competitive, manufacturers mass produce the spring coil assemblies, and are therefore limited to coil configurations obtainable with automated assembly machines. Consequently, known spring coil assemblies comprised of left-hand and right-hand coils have been configured substantially as shown in FIG. 1.

To vary the overall firmness of the assembly, it is known to utilize coils made from different gauges of wire, thereby varying the spring characteristics and making the coil assembly softer or firmer. Again, due to the limitations of mass production, all of the right-hand coils are made from the same gauge of wire and all of the left-hand coils are made from the same gauge of wire. While the gauge of wire used for the left-hand coils may be different from the gauge of wire used for the right-hand coils, there are at most only two gauges of wire used in any one spring coil assembly. Since the configuration of coils maintains substantially the same pattern seen in FIG. 1, varying the wire gauge only allows for substantially homogenous variation of the firmness over the entire assembly.

In order to vary the firmness in different areas of the assembly, it is necessary to vary the spacing between the coils in each row. Due to the automated equipment used for mass production, this varied spacing is consistent throughout the rows of the spring coil assembly. This means that softer areas and firmer areas will run across the entire spring assembly in bands, i.e., along columns of coils.

SUMMARY OF THE INVENTION

The present invention provides a mattress or spring coil assembly construction having variation along the rows of the spring assembly to suit the needs of the consumer. The arrangement of coils is flexible, however, in that variations or permutations of the coil arrangement can be achieved within the scope of the present invention to provide multiple embodiments of the spring coil assembly. The multiple embodiments provide various characteristics and can be used to change the firmness of mass-produced coil assemblies in predetermined locations or zones as well as over the entire assembly. Advantageously, this coil assembly customization moves beyond simple selection of the firmness of the entire spring coil assembly or selected bands, and now allows the consumer to specify zones of the assembly where softer or firmer support is desired. The zones need not run across the entire assembly and therefore allow softer areas to be completely surrounded by firmer areas or vice-versa.

The present invention also provides an apparatus for making and assembling the multiple spring coil assembly embodiments. In one embodiment, the apparatus comprises a main conveyor adapted to convey a plurality of coils along an axis, an assembler which is operable to intertwine a plurality of coils into a spring coil assembly, and a transfer station operable to move a plurality of coils from the main conveyor into the assembler. The transfer station includes a plurality of pusher arms, each of which have a gripper that is operable to grasp an individual coil. The transfer station also includes a carriage supporting the gripper arms and a device for shifting the carriage in a direction substantially parallel to the axis so that the plurality of coils carried by the gripper arms are displaced in the direction of travel of the conveyor.

In another embodiment, the apparatus includes a coil forming machine having a wire feed advancing mechanism and being capable of forming coils in response to the advancement of wire by the wire feed advancing mechanism. The apparatus also includes a programmable control system capable of selectively varying the advancement of wire by the wire feed advancing mechanism between a consistent advancement, wherein coils are formed and placed on a main conveyor in predetermined consistent intervals, and an inconsistent advancement, wherein coils are formed and placed on the main conveyor in predetermined inconsistent intervals. In one aspect of the invention, the apparatus also includes a sensor element capable of producing a signal that can be selectively interpreted by the control system to stop the manufacturing of the spring coil assembly when the spacing of the coils on the main conveyor is inconsistent, or to permit the manufacturing of the spring coil assembly when the spacing of the coils on the main conveyor is inconsistent.

The present invention further provides a method of arranging coils in a spring coil assembly. The method includes arranging a first plurality of right-hand coils in spaced apart relation in a first row, arranging a first plurality of left-hand coils in spaced apart relation in the first row such that each of the first plurality of left-hand coils in the first row is located between a respective pair of right-hand coils in the first row, arranging a second plurality of right-hand coils in spaced apart relation in a second row, arranging a second plurality of left-hand coils in spaced apart relation in the second row such that each of the second plurality of left-hand coils in the second row is located between a respective pair of right-hand coils in the second row, and arranging the first and second rows such that the first plurality of right-hand coils in the first row is out of phase with the second plurality of right-hand coils in the second row.

In another embodiment, the method includes providing a coil forming machine having a wire feed advancing mechanism and that is capable of forming coils in response to the advancement of wire by the wire feed advancing mechanism. The method further includes selectively varying the advancement of wire by the wire feed advancing mechanism between a consistent advancement, wherein coils are formed and placed on a main conveyor in predetermined consistent intervals, and an inconsistent advancement, wherein coils are formed and placed on the main conveyor in predetermined inconsistent intervals.

In one aspect of the invention, the method also includes selectively disregarding or disabling a sensor element that produces a signal intended to stop the manufacturing of the spring coil assembly when the coils on the main conveyor are spaced at inconsistent intervals.

Other features and advantages of the invention will become apparent to those skilled in the art upon review of the following detailed description, claims, and drawings.

Figure 1:
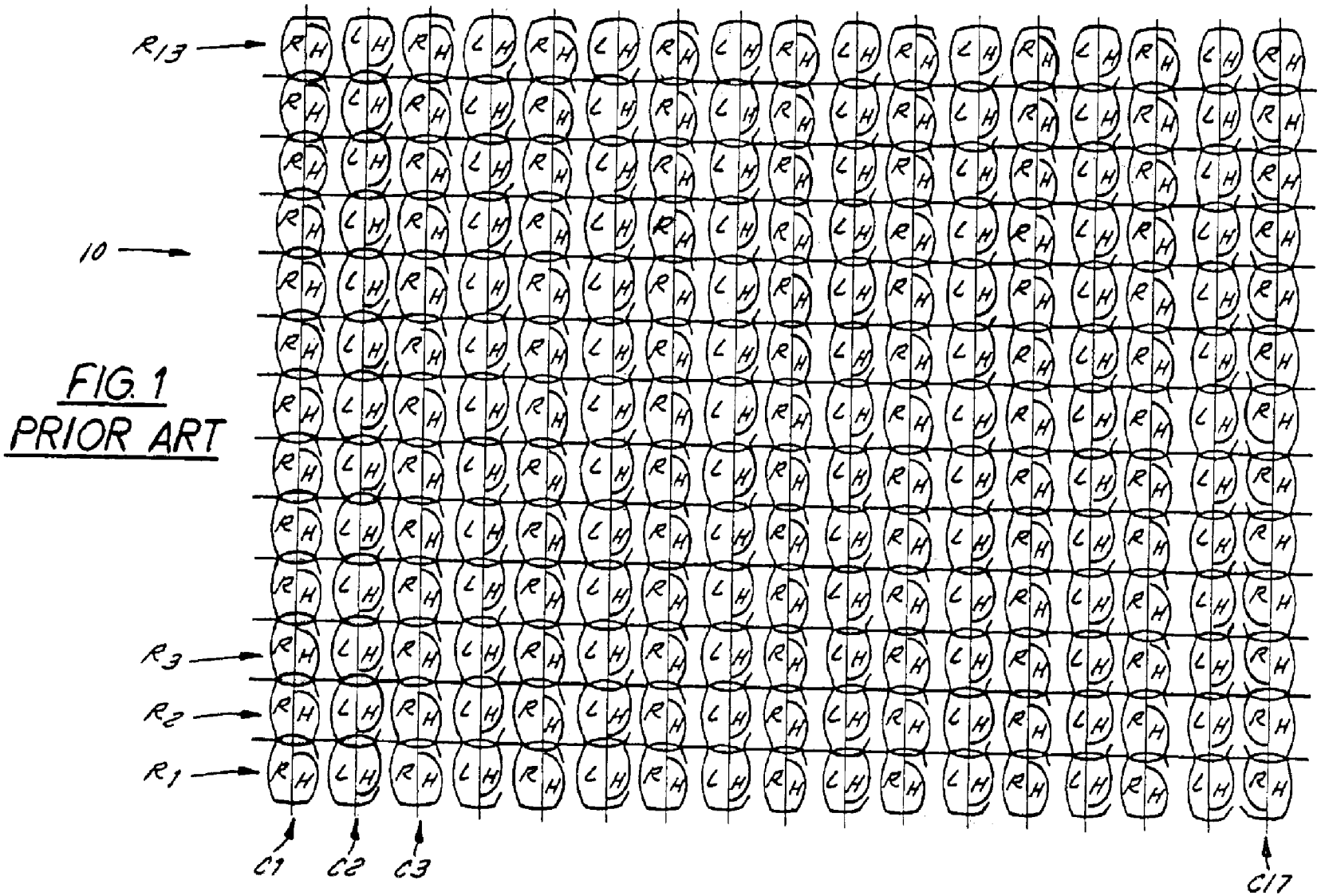
FIG. 1 PRIOR ART
FIG. 1 is a schematic top view of a prior art spring coil assembly.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 2:
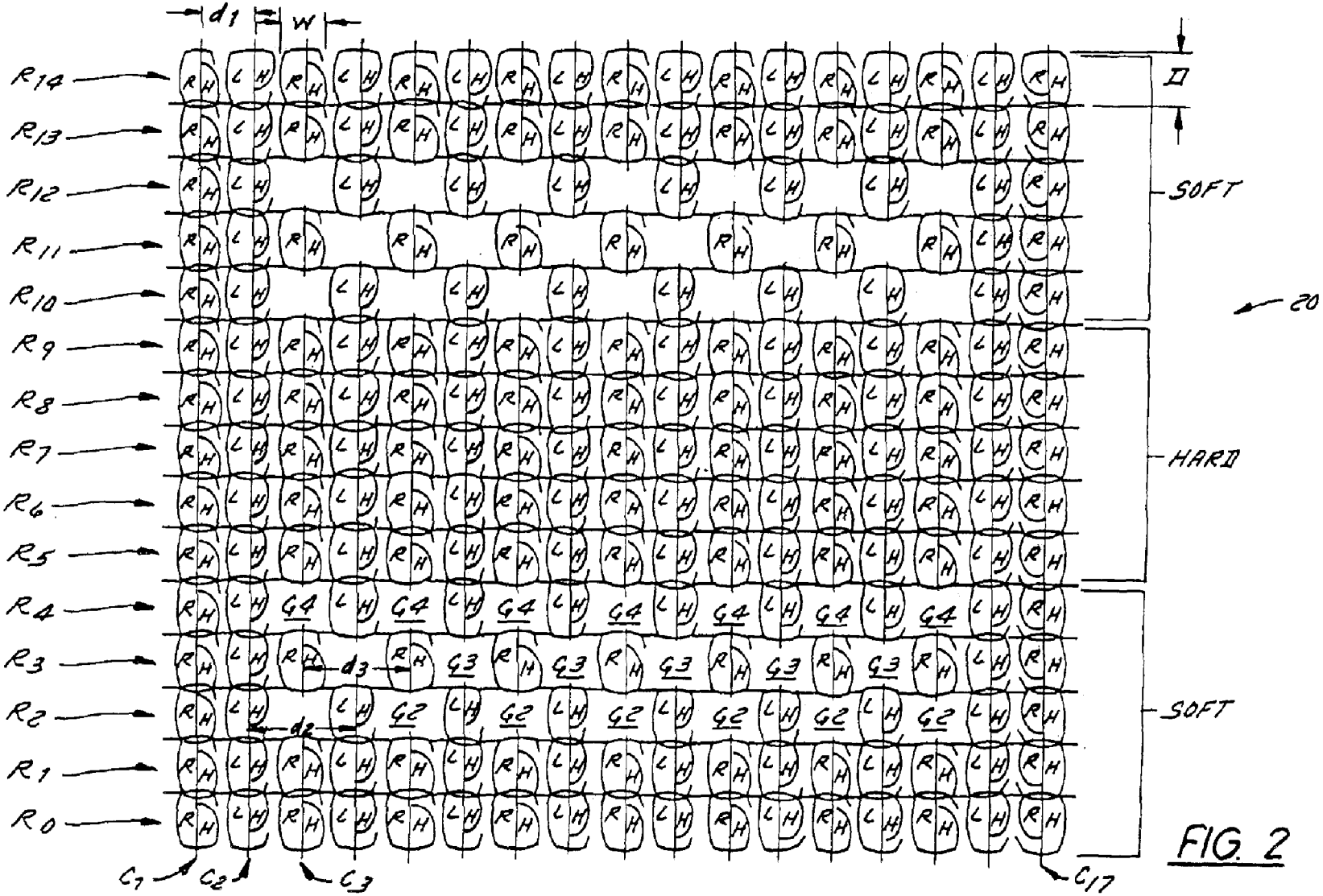
FIG. 2 is a schematic top view of a first spring coil assembly embodying the invention.

FIG. 2 illustrates a spring coil assembly 20 which this disclosure may sometimes identify as "the standard posturized unit." The assembly 20 includes multiple rows R and multiple columns C of right-hand and left-hand coils. The right-hand coils can be made from a different gauge of wire than the left-hand coils, but this is not a requirement of the invention. Furthermore, the right-hand and left-hand coils have a substantially identical widths W and depths D.

A first row $R_1$ includes a plurality of alternating right-hand and left-hand coils arranged in a first spacing pattern. Adjacent pairs of coils in the first row $R_1$ are uniformly spaced at a first distance $d_1$. A second row $R_2$ adjacent the first row $R_1$ includes a plurality of right-hand and left-hand coils arranged in a second spacing pattern that is different from the first spacing pattern of the first row $R_1$. At least one adjacent pair of coils in the second row $R_2$ is spaced at a second distance $d_2$ that is different from the first distance $d_1$. The different spacing pattern in the second row $R_2$ is achieved by using at least one less coil in the second row $R_2$ than is used in the first row $R_1$.

As seen in FIG. 2, the second row $R_2$ preferably has fewer right-hand coils than left-hand coils. This is achieved by eliminating at least one, and preferably more, of the right-hand coils from the normally alternating pattern used in the first row $R_1$. Eliminating the right-hand coils in this manner provides gaps $G_2$ that are substantially equal in size to the width W of a right-hand coil. The gaps $G_2$ cause a change in characteristics of the spring coil assembly 10 between the first and second rows $R_1$ and $R_2$. More specifically, the gaps $G_2$ make the assembly 20 softer or less firm in the second row $R_2$ than in the first row $R_1$.

The spring coil assembly 20 further includes a third row $R_3$ adjacent the second row $R_2$. The third row $R_3$ includes a plurality of right-hand and left-hand coils arranged in a third spacing pattern that is different from the first spacing pattern of the first row $R_1$ and can be different from the second spacing pattern of the second row $R_2$. At least one pair of adjacent coils in the third row $R_3$ is spaced at a third distance $d_3$ that is the same as the second distance $d_2$. The third row $R_3$ preferably has fewer left-hand coils than right-hand coils. This is achieved by eliminating at least one, and preferably more, of the left-hand coils from the normally alternating pattern used in the first row $R_1$. Eliminating the left-hand coils in this manner provides gaps $G_3$ that are substantially equal in size to the width W of a left-hand coil. As seen in FIG. 2, the third row gaps $G_3$ alternate out of phase with the second row gaps $G_2$. As used herein and in the appended claims to describe the spatial relationship of coils and/or gaps in adjacent rows, the term "out of phase" means offset substantially by the distance of one coil width W in either direction along the row.

The coil assembly 20 also includes a fourth row $R_4$ that is substantially identical to the second row $R_2$ and is adjacent the third row $R_3$. The fourth row $R_4$ includes gaps $G_4$ that alternate out of phase with the third row gaps $G_3$. A fifth row $R_5$ is substantially identical to the first row $R_1$ and is adjacent the fourth row $R_4$. The fourth row $R_4$ is softer or less firm than the fifth row $R_5$ due to the presence of gaps $G_4$.

The arrangement of the rows $R_1$, $R_2$, $R_3$, $R_4$ and $R_5$ illustrates how the spring coil assembly 20 can be customized to have firmer zones and softer zones that do not extend across the entire assembly 20 in the direction of the columns C. The softer arrangement of rows $R_1$ to $R_5$ can be located in areas of a mattress requiring less support, such as the areas under a person's head or feet.

The coil assembly 20 also includes sixth, seventh and eighth rows $R_6$, $R_7$ and $R_8$ that are substantially identical to the first row $R_1$. The arrangement of rows $R_6$ to $R_8$ provides a firmer area of the assembly 10 and can be located in areas of a mattress requiring more support, such as the areas under a person's torso or mid-section.

The coil assembly 20 also includes ninth, tenth, eleventh, twelfth and thirteenth rows $R_9$, $R_{10}$, $R_{11}$, $R_{12}$ and $R_{13}$ that are substantially identical to the rows $R_1$, $R_2$, $R_3$, $R_4$ and $R_5$, respectively. Like the arrangement of rows $R_1$ to $R_5$, the arrangement of the rows $R_9$ to $R_{13}$ can be located in areas of a mattress requiring less support, such as the areas under a person's head or feet. Finally, the coil assembly 20 includes end rows $R_0$ and $R_{14}$ that are substantially identical to the first row $R_1$. The end rows $R_0$ and $R_{14}$ provide firm support around their respective portions of the perimeter of the coil assembly 20.

The arrangement of the rows R of the coil assembly 20 drives the arrangement of the columns C. It is worth noting that the coil assembly 20 includes columns C that consist entirely of either of all left-hand coils or all right-hand coils. The gaps G in the rows also create gaps in the columns C. The gaps in any two adjacent columns are out of phase with one another, just as is the case with adjacent rows. As used herein and in the appended claims to describe the spatial relationship of coils and/or gaps in adjacent columns, the term "out of phase" means offset substantially by the distance of one coil depth D in either direction along the column.

It is important to note that the coil assembly 20 is not limited to the configuration shown in FIG. 2. For example, the coil assembly 20 could be practiced with two or more end rows at each end of the assembly 20. Alternatively, the assembly 20 need not have any end rows at all. In addition, it should be noted that the length of the individual rows can vary to fit the dimensional requirements of the coil assembly 20.

Furthermore, it is important to note that the relative arrangement of coils illustrated between rows $R_1$ and $R_5$ could include fewer or more rows like rows $R_2$, $R_3$ and $R_4$. The alternating sequence of rows $R_2$ and $R_3$ could also be transposed to change the arrangement of gaps $G_2$ and $G_3$. If this were the case, it would also be desirable, but not necessary, to transpose any additional rows (e.g. $R_4$) to continue the proper out of phase, alternating gap sequence. Likewise, the arrangement illustrated between rows $R_6$ and $R_8$ can include fewer or more rows like $R_7$.

Figure 3:
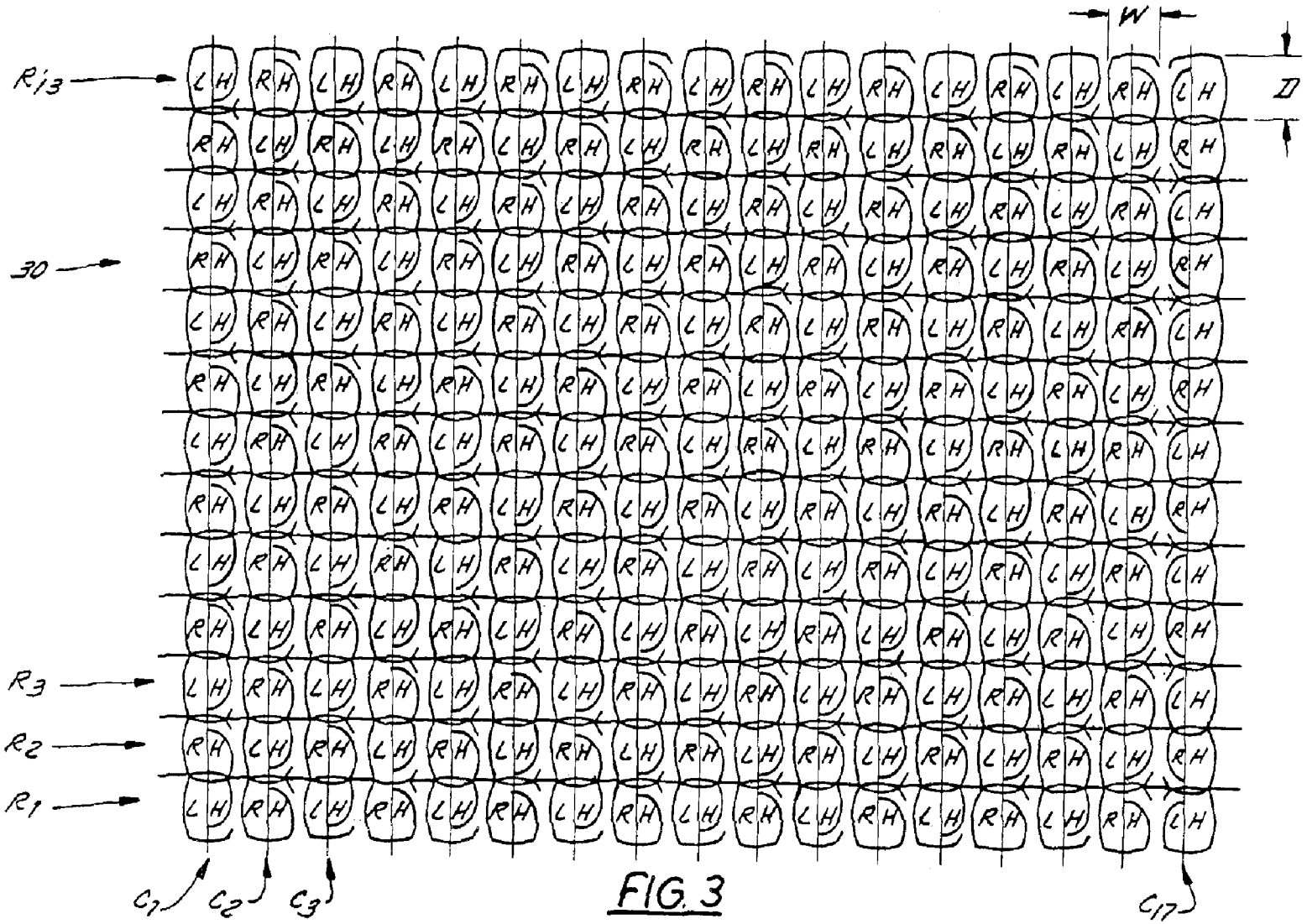
FIG. 3 is a schematic top view of a second spring coil assembly which is an alternative embodiment of the invention.

FIG. 3 illustrates a spring coil assembly 30 that is a second embodiment of the present invention which this disclosure may sometimes identify as the "X unit." The assembly 30 includes multiple rows R and multiple columns C of right-hand and left-hand coils. The right-hand coils can be made from a different gauge of wire than the left-hand coils, but this is not a requirement of the invention. Furthermore, the right-hand and left-hand coils have a substantially identical widths W and depths D.

The rows R consist of alternating left-hand and right-hand coils. As seen in FIG. 3, a first row $R_1$ is adjacent a second row $R_2$ and the plurality of right-hand coils in the first row $R_1$ alternates out of phase with the plurality of right-hand coils in the second row $R_2$. Likewise, the plurality of left-hand coils in the first row $R_1$ alternates out of phase with the plurality of left-hand coils in the second row $R_2$. Due to the alternating coil configuration in the rows, the assembly 30 also has an alternating arrangement of right-hand and left-hand coils in the columns C. Unlike the prior art coil assembly 10 of FIG. 1, the coil assembly 30 of FIG. 3 has this alternating arrangement of left-hand and right-hand coils in both the rows R and the columns C, and therefore provides a more homogenous coil arrangement that is advantageous in terms of comfort and support.

Figure 4:
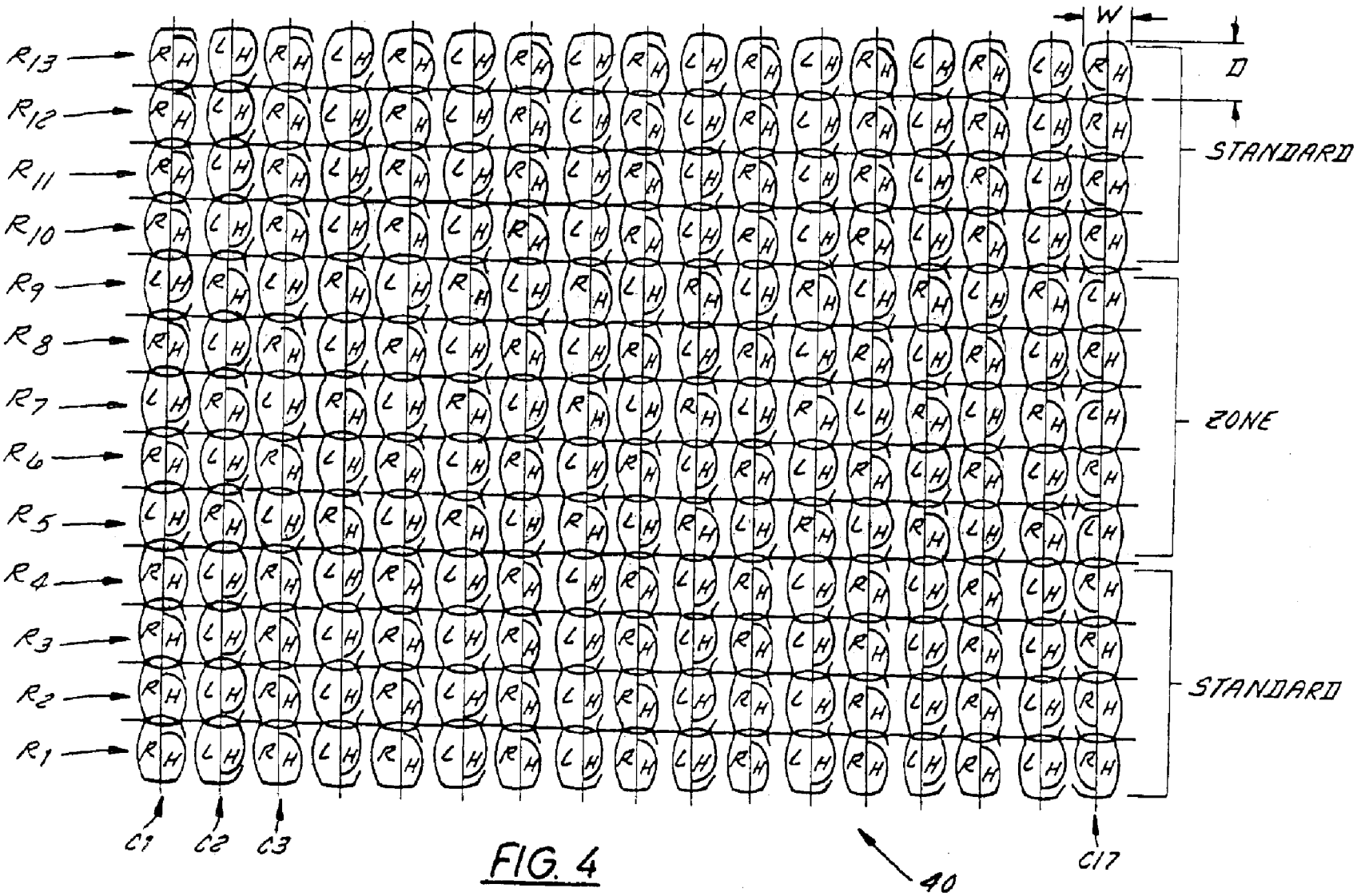
FIG. 4 is a schematic top view of a third spring coil assembly which is an alternative embodiment of the invention.

FIG. 4 illustrates a spring coil assembly 40 that is a third embodiment of the present invention which this disclosure may sometimes identify as the "zoned unit." The assembly 40 again includes multiple rows R and multiple columns C of right-hand and left-hand coils. The right-hand coils can be made from a different gauge of wire than the left-hand coils, but this is not a requirement of the invention. Furthermore, the right-hand and left-hand coils have a substantially identical widths W and depths D.

Again, the rows R consist of alternating left-hand and right-hand coils. As seen in FIG. 4, the first four rows $R_1$ to $R_4$ and the last four rows $R_{10}$ to $R_{13}$ are arranged like the rows in the prior art assembly 10. The fifth through ninth rows $R_5$ to $R_9$ are arranged in the manner described above with respect to the "X unit" coil assembly 30 of FIG. 3. In other words, the plurality of right-hand coils in row $R_4$ alternates out of phase with the plurality of right-hand coils in row $R_5$, which in turn, alternates out of phase with the plurality of right-hand coils in row $R_6$. Consequently, the plurality of left-hand coils in row $R_4$ alternates out of phase with the plurality of left-hand coils in row $R_5$, which in turn, alternates out of phase with the plurality of left-hand coils in row $R_6$. This arrangement continues through row $R_{10}$ to form a zone in the assembly 40 that has the more homogenous coil arrangement described above with respect to assembly 30.

It should be noted that the assembly 40 is not limited to the particular configuration of rows shown in FIG. 4, but can include zones having different numbers of rows as well as multiple zones within the assembly 40. The coil assembly 30 is also assembled using the apparatus 60 described below.

Figure 5:
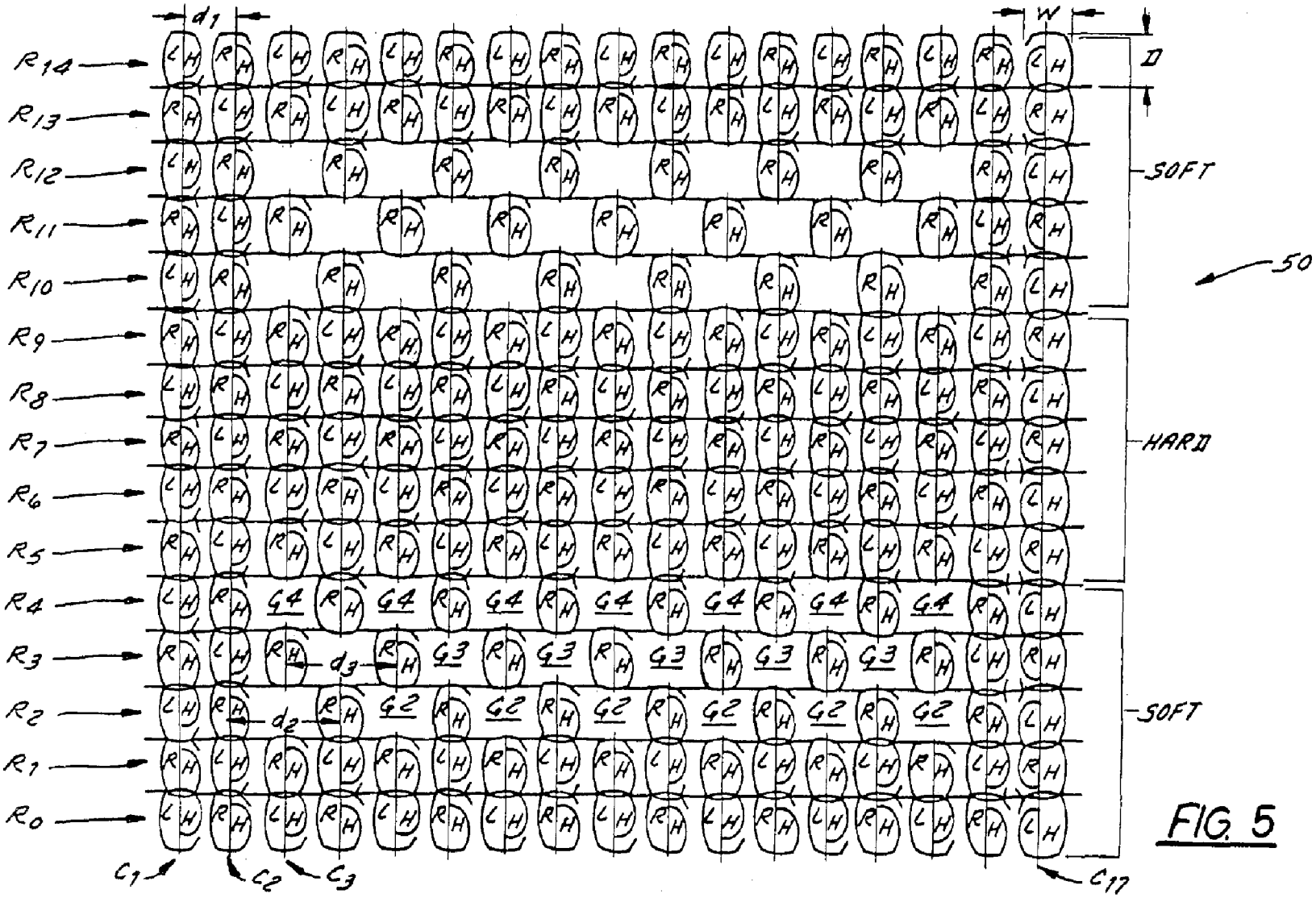
FIG. 5 is a schematic top view of a fourth spring coil assembly which is an alternative embodiment of the invention.

FIG. 5 illustrates a fourth embodiment of a spring coil assembly 50 of the present invention which this disclosure may sometimes identify as "the X posturized unit." The assembly 50 includes multiple rows R and multiple columns C of right-hand and left-hand coils. The right-hand coils can be made from a different gauge of wire than the left-hand coils, but this is not a requirement of the invention. Furthermore, the right-hand and left-hand coils have a substantially identical widths W and depths D.

The coil assembly 50 combines the standard posturized arrangement of the coil assembly 20 shown in FIG. 2, with the out of phase alternating coil arrangement of the X unit coil assembly 30 shown in FIG. 3. More specifically, a first row $R_1$ includes a plurality of alternating right-hand and left-hand coils arranged in a first spacing pattern. Adjacent pairs of coils in the first row $R_1$ are uniformly spaced at a first distance $d_1$. A second row $R_2$ adjacent the first row $R_1$ includes a plurality of right-hand and left-hand coils arranged in a second spacing pattern that is different from the first spacing pattern of the first row $R_1$. At least one adjacent pair of coils in the second row $R_2$ is spaced at a second distance $d_2$ that is different from the first distance $d_1$. The different spacing pattern in the second row $R_2$ is achieved by using at least one less coil in the second row $R_2$ than is used in the first row $R_1$. Furthermore, the plurality of right-hand coils in the first row $R_1$ alternates out of phase with the plurality of right-hand coils in the second row $R_2$.

As seen in FIG. 5, the second row $R_2$ preferably has fewer left-hand coils than right-hand coils. This is achieved by eliminating at least one, and preferably more, of the left-hand coils from the normally alternating pattern used in the first row $R_1$. Eliminating the left-hand coils in this manner provides gaps $G_2$, that are substantially equal in size to the width W of a left-hand coil. The gaps $G_2$ cause a change in characteristics of the spring coil assembly 50 between the first and second rows $R_1$ and $R_2$. More specifically, the gaps $G_2$ make the assembly 50 softer or less firm in the second row $R_2$ than in the first row $R_1$.

The spring coil assembly 50 further includes a third row $R_3$ adjacent the second row $R_2$. The third row $R_3$ includes a plurality of right-hand and left-hand coils arranged in a third spacing pattern that is different from the first spacing pattern of the first row $R_1$ and can be different from the second spacing pattern of the second row $R_2$. At least one pair of adjacent coils in the third row $R_3$ is spaced at a third distance $d_3$ that is the same as the second distance $d_2$. The third row $R_3$ preferably has fewer left-hand coils than right-hand coils. This is achieved by eliminating at least one, and preferably more, of the left-hand coils from the normally alternating pattern used in the first row $R_1$. Eliminating the left-hand coils in this manner provides gaps $G_3$ that are substantially equal in size to the width W of a left-hand coil. As seen in FIG. 5, the third row gaps $G_3$ alternate out of phase with the second row gaps $G_2$. Additionally, the plurality of right-hand coils in the second row $R_2$ alternate out of phase with the plurality of right-hand coils in the third row $R_3$.

The coil assembly 50 also includes a fourth row $R_4$ that is substantially identical to the second row $R_2$ and is adjacent the third row $R_3$. The fourth row $R_4$ includes gaps $G_4$ that alternate out of phase with the third row gaps $G_3$. A fifth row $R_5$ is substantially identical to the first row $R_1$ and is adjacent the fourth row $R_4$. The fourth row $R_4$ is softer or less firm than the fifth row $R_5$ due to the presence of gaps $G_4$.

The arrangement of the rows $R_1$, $R_2$, $R_3$, $R_4$ and $R_5$ illustrates how the spring coil assembly 50 can be customized to have firmer zones and softer zones that do not extend across the entire assembly 50 in the direction of the columns C. The softer arrangement of rows $R_1$ to $R_5$ can be located in areas of a mattress requiring less support, such as the areas under a person's head or feet.

The coil assembly 50 also includes sixth, seventh and eighth rows $R_6$, $R_7$ and $R_8$ that are arranged like the rows of coil assembly 30. The arrangement of rows $R_6$ to $R_8$ provides a homogenous and firmer area of the assembly 50 and can be located in areas of a mattress requiring more support, such as the areas under a person's torso or mid-section.

The coil assembly 50 also includes ninth, tenth, eleventh, twelfth and thirteenth rows $R_9$, $R_{10}$, $R_{11}$, $R_{12}$ and $R_{13}$ that are substantially identical to the rows $R_1$, $R_2$, $R_3$, $R_4$ and $R_5$, respectively. Like the arrangement of rows $R_1$ to $R_5$, the arrangement of the rows $R_9$ to $R_{13}$ can be located in areas of a mattress requiring less support, such as the areas under a person's head or feet. Finally, the coil assembly 50 includes an end row $R_0$ in out of phase relation to row $R_1$ and an end row $R_{14}$ in out of phase relation row $R_{13}$. The end rows $R_0$ and $R_{14}$ provide firm support around their respective portions of the perimeter of the coil assembly 50.

The arrangement of the rows R of the coil assembly 50 drives the arrangement of the columns C. The gaps G in the rows also create gaps in the columns C. The gaps in any two adjacent columns are out of phase with one another, just as is the case with adjacent rows. It is worth noting that the coil assembly 50 includes columns C that consist both of alternating and consecutive left-hand coils or right-hand coils. In locations in a column where no gap exists between two consecutive rows, the adjacent coils of the column alternate between left-hand and right-hand coils. In locations in a column where a gap does exist between two consecutive rows, the adjacent coils of the column will be of the same hand (right-handed as shown in FIG. 5).

It is important to note that the coil assembly 50 is not limited to the configuration shown in FIG. 5. For example, the coil assembly 50 could be practiced with two or more end rows at each end of the assembly 50. Alternatively, the assembly 50 need not have any end rows at all. In addition, it should be noted that the length of the individual rows can vary to fit the dimensional requirements of the coil assembly 50.

Furthermore, it is important to note that the relative arrangement of coils illustrated between rows $R_1$ and $R_5$ could include fewer or more rows like rows $R_2$, $R_3$ and $R_4$. The alternating sequence of rows $R_2$ and $R_3$ could also be transposed to change the arrangement of gaps $G_2$ and $G_3$. If this were the case, it would also be desirable, but not necessary, to transpose any additional rows (e.g. $R_4$) to continue the proper out of phase, alternating gap sequence. Likewise, the arrangement illustrated over rows $R_6$ to $R_8$ can include fewer or more rows.

Figure 6:
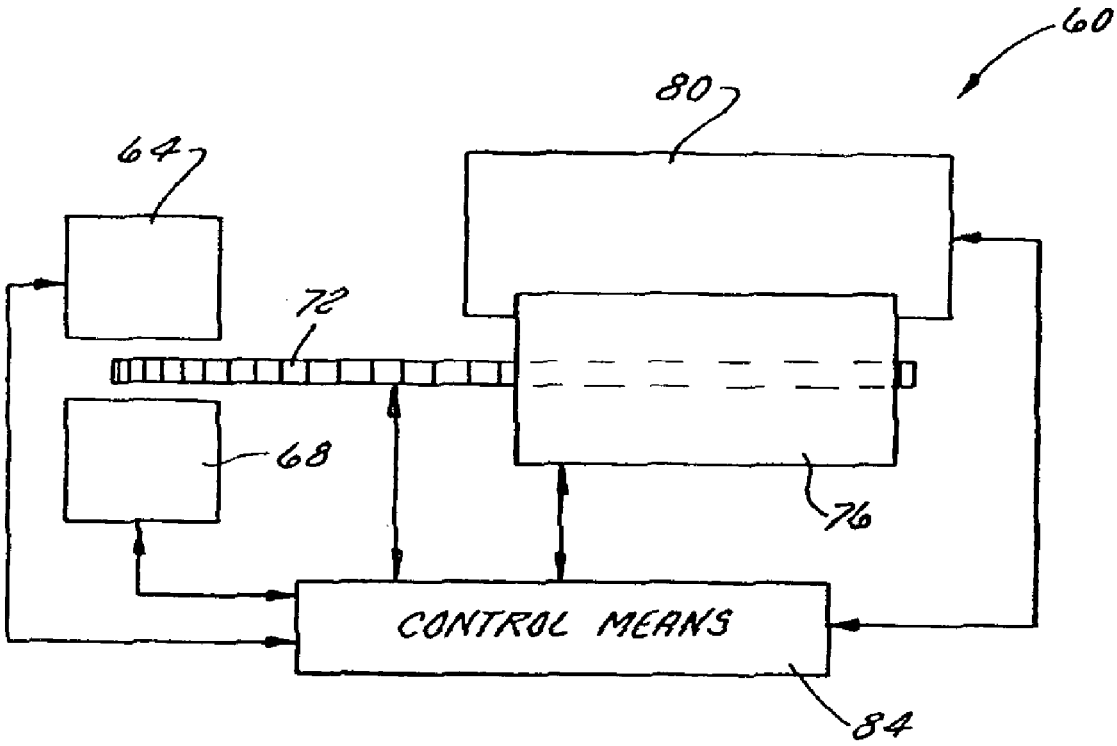
FIG. 6 is a schematic top view of an apparatus embodying the invention, which can be used to assemble the spring coil assemblies illustrated in FIGS. 2–5.

All of the previously-described spring coil assemblies 10, 20, 30, 40, and 50 can be made using a coil spring forming and assembly apparatus 60, as shown in FIGS. 6–11. The general construction and operation of the apparatus 60 is described in U.S. Pat. No. 5,950,473, which is commonly assigned to the assignee of this application and is hereby incorporated by reference. Referring to FIG. 6, the coil spring forming and assembling apparatus 60 includes first and second coil forming machines 64 and 68, respectively, which form and deliver coil springs to a single, incrementally advancing main conveyor 72. The main conveyor 72 delivers the coil springs to a coil spring transfer apparatus 76 which, in turn, delivers the coil springs to a coil spring assembly apparatus 80. The coil spring assembly apparatus 80 assembles the coil springs into the various coil spring assemblies 10, 20, 30, 40, and 50 described above.

The coil spring forming and assembling apparatus 60 also includes a control system 84, according to which, operation of the coil spring forming machines 64 and 68 are dependent on completion of the incremental advancement of the main conveyor 72, and operation of the main conveyor 72 is dependent on completion and delivery of a fully completed coil spring by one or both of the coil spring forming machines 64 and 68. As will be described below, the control system 84 used with the present invention can be programmed to operate the coil spring forming machines 64 and 68 and the main conveyor 72 even if a coil is missing on the main conveyor 72, as is the case when a gap is required in the coil spring assembly. The control system 84 can also distinguish between an expected missing coil (i.e., a coil left out intentionally to provide a gap) and an unexpected missing coil (i.e., a coil that accidentally fell off the main conveyor 72), in order to determine whether the coil forming and assembling apparatus 60 should be shut down or whether it should continue to run. In prior art coil forming and assembly machines on the other hand, the absence of a coil would typically stop the spring forming machines and the main conveyor so that the missing coil could be replaced.

Figure 7:
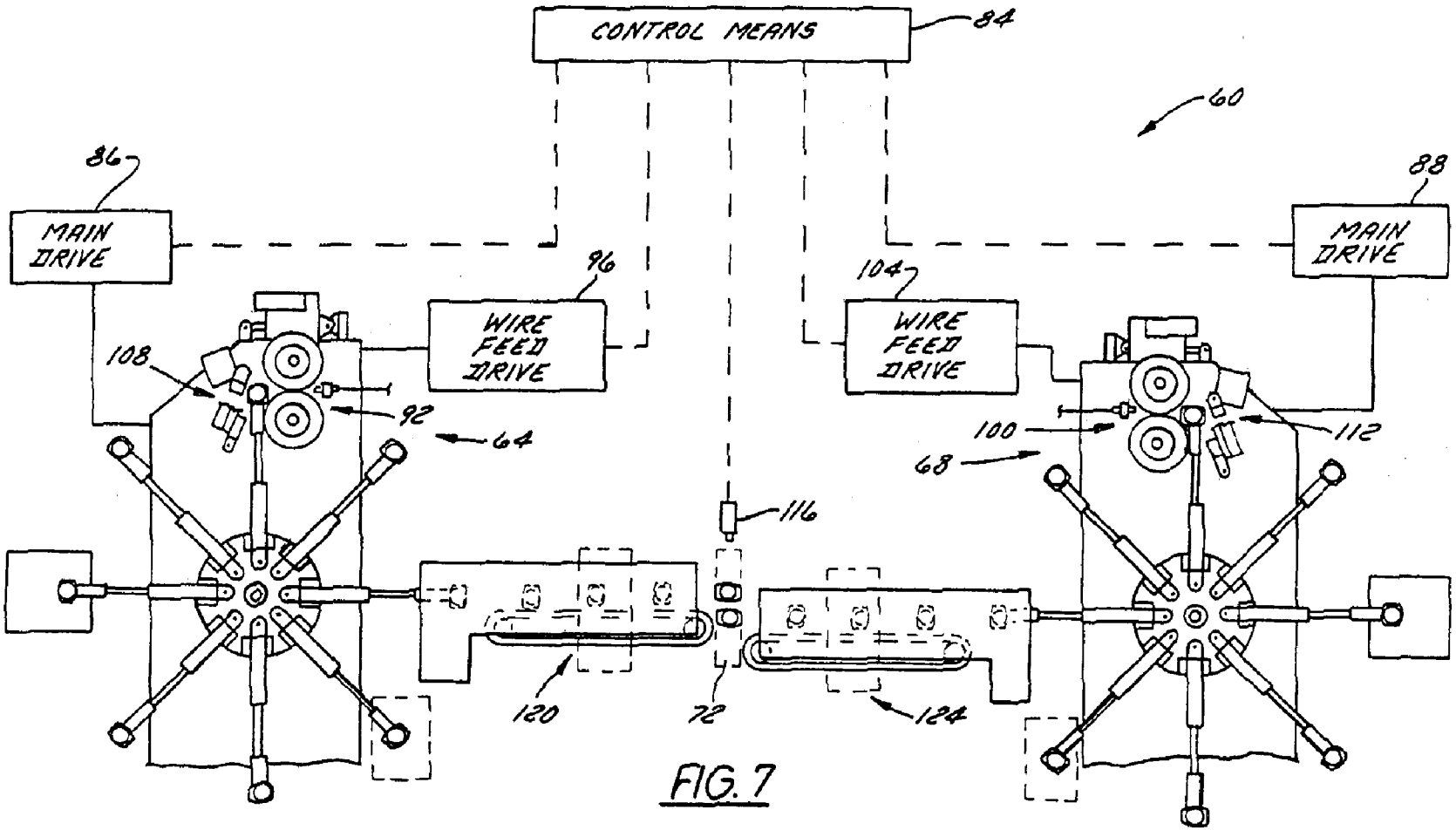
FIG. 7 is a partial left side view of the apparatus of FIG. 6.

FIG. 7 shows the coil forming machines 64 and 68 in greater detail. The coil forming machines 64 and 68 are substantially mirror images of one another, with one of the coil forming machines 64 and 68 forming left-hand coils and the other of the coil forming machines 64 and 68 forming right-hand coils. Coil forming machines of this type are well-known and will not be described in detail. The coil forming machine 64 is driven by a main driving device 86 and the coil forming machine 68 is driven by a main driving device 88. The coil forming machine 64 includes a wire feed advancing mechanism 92 that is driven by wire-feed driving device 96, which is operative and energized in response to operation of the main driving device 86. Likewise, the coil forming machine 68 includes a wire feed advancing mechanism 100 that is driven by wire-feed driving device 104, which is operative and energized in response to operation of the main driving device 88. The construction of the wire feed advancing mechanisms 92 and 100 is also well-known.

Wire is fed by the wire feed advancing mechanisms 92 and 100 to respective coil spring forming heads 108 and 112 that operate to form each individual coil. The wire feed driving devices 96 and 104 are energized in response to signals from the control system 84. When the driving devices 96 and 104 receive the signals, the wire feed advancing mechanisms 92 and 100 feed the wire to the forming heads 108 and 112 in order to form the coils. Previously, these signals were sent at consistent intervals, and therefore, coils were formed at consistent intervals.

To create the desired spacing gaps in the spring coil assemblies 20 and 50, the control system programming can be altered to send energization signals to the wire feed driving devices 96 and 104 at predetermined inconsistent intervals. In other words, the previously consistent pattern of energization signals may now be made inconsistent by eliminating one or more energization signals. If the drive devices 96 and 104 do not receive an energization signal, no wire will be advanced by the respective wire feed advancing mechanisms 92 and 100 and no coil will be formed.

Meanwhile, the rest of the coil forming, conveying, and assembling operations continue to index as if a coil were actually formed in the usual consistent manner. Therefore the gap created by the missing coil is never filled, but rather persists throughout the indexing. The transferring of coils to the main conveyor 72 continues in the usual manner. As a result, the spacing of the coils on the main conveyor 72, which ultimately corresponds substantially to the spacing of the coils in the various rows of the spring coil assemblies 20 and 50, is inconsistent due to the gaps created by the missing coils. Using this technique, spacing gaps can be created by selectively controlling the wire feed advancing mechanisms 92 and 100 on the left-hand and/or the right-hand coil forming machines 64 and 68, as desired.

Of course, gaps can also be created in other ways, such as by manually or automatically removing selected coils after they have been formed. However, selectively controlling the wire feed as described above creates gaps without generating extra coils that must be discarded. This reduces the cost of manufacturing spring coil assemblies.

As the gap created by the missing coil advances through the various forming, conveying, and assembling stations, it may be necessary to disable or disregard any sensing devices normally used to detect missing coils. As seen in FIG. 7, the apparatus 60 includes a sensor 116 positioned above the main conveyor 72. The sensor 116 is coupled to the control system 84 and detects when a coil is missing from the main conveyor 72. Any suitable sensor, including optical sensors, limit switches, proximity sensors and the like, can be used. Additionally, the sensor 116 can be located at other places on the apparatus 60.

As mentioned above, for making spring coil assemblies that have gaps, the control system 84 is programmed to know when to expect a missing coil so that the coil forming and assembling apparatus 60 continues to operate. However, if the sensor 116 detects an unexpected missing coil, the coil forming and assembling apparatus 60 can still be shut down. For example, in the situation where gaps are desired and the coils are intentionally missing, the control system programming is altered to anticipate missing coils in certain intervals or incremental positions. If the signal from the sensor 116 indicates that a coil is missing, and that signal is expected, the operation would not be shut down, but rather would continue as normal. Yet, if an unexpected missing coil signal from the sensor 116 is received, the operation can still be shut down.

From the coil forming machines 64 and 68, the coils are transferred to respective infeed conveyors 120 and 124. The infeed conveyors 120 and 124 carry the coils to the main conveyor 72 which travels along an axis 128. The coils are transferred to the main conveyor 72 such that the coils on the main conveyor 72 are arranged in a uniformly spaced-apart alternating sequence of right-hand and left-hand coils. The infeed conveyors are described in detail in pending U.S. pat. app. Ser. No. 09/753,936, which is hereby incorporated by reference.

Figure 8:
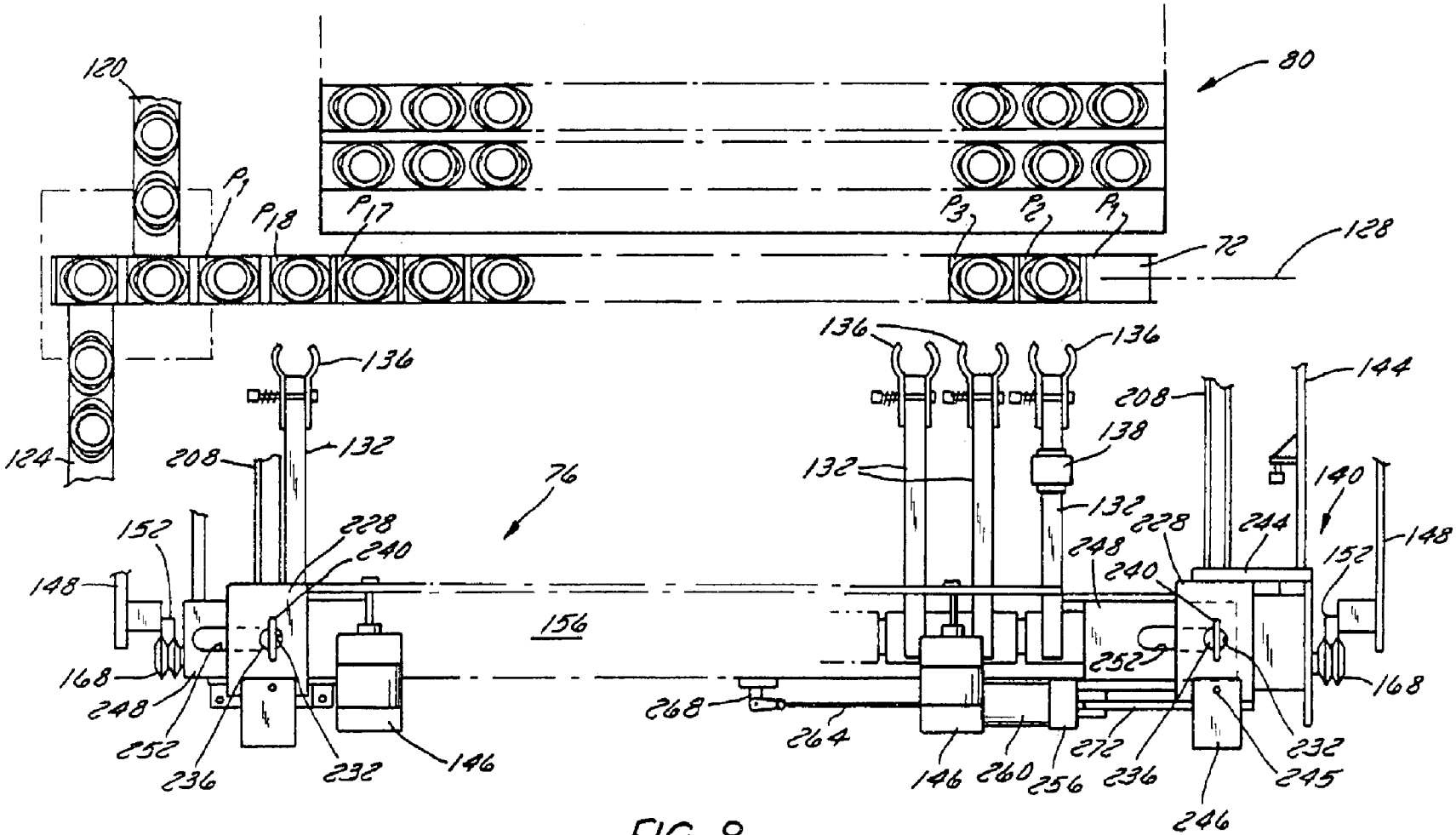
FIG. 8 is a partial top view of the apparatus of FIG. 6.

Referring to FIG. 8, the infeed conveyors 120 and 124 continue to supply coils to the main conveyor 72. The main conveyor 72 carries the coils to a position adjacent the assembly apparatus 80, which is operable to intertwine a row R of coils into a spring coil assembly. Associated with the assembly apparatus 80 is the transfer apparatus 76, which is operable to move a row R of coils from the main conveyor 72 into the assembly apparatus 80. In general, the transfer apparatus 76 and the assembly apparatus 80 are located on opposite sides of the main conveyor 72, with the assembly apparatus 80 being vertically offset upwardly from the main conveyor 72. The main conveyor 72 advances a first row R of coils to the transfer apparatus 76 in a direction of motion along the axis 128 into a loading position adjacent the transfer apparatus 76 and the assembly apparatus 80. The transfer apparatus 76 removes the first row R of coils from the main conveyor 72 and places the coils into the assembly apparatus 80. During the transfer of the first row R of coils from the main conveyor 72 to the assembly apparatus 80, the main conveyor 72 advances a second row R of coils into the loading position.

Various configurations and arrangements can be successfully used for the transfer apparatus 76. In the illustrated embodiment, the transfer apparatus 76 includes a plurality of pusher arms 132, each of which includes a gripper 136 which is operable to grasp an individual coil. In the illustrated embodiment, the first pusher arm 132 (shown as the right-most pusher arm in FIGS. 8 and 9) can be rotated by an actuator 138 to rotate the end coil for assembly, as is known by those skilled in the art. The pusher arms 132 are coupled to a pusher carriage 140, which is supported by a frame 144 in a manner discussed below, so as to afford movement of the pusher arms 132 in several degrees of freedom. Gripper actuators 146 are mounted on the pusher carriage 140 and operate to open and close the grippers 136 in a known manner.

The frame 144 includes opposing vertical members 148, which are substantially mirror images of one another. Each vertical frame member 148 includes a pair of spaced-apart vertical guide rails 152 (only one is shown at each end of the frame 144) that guides the vertical movement of the pusher carriage 140 relative to the frame 144.

Figure 10:
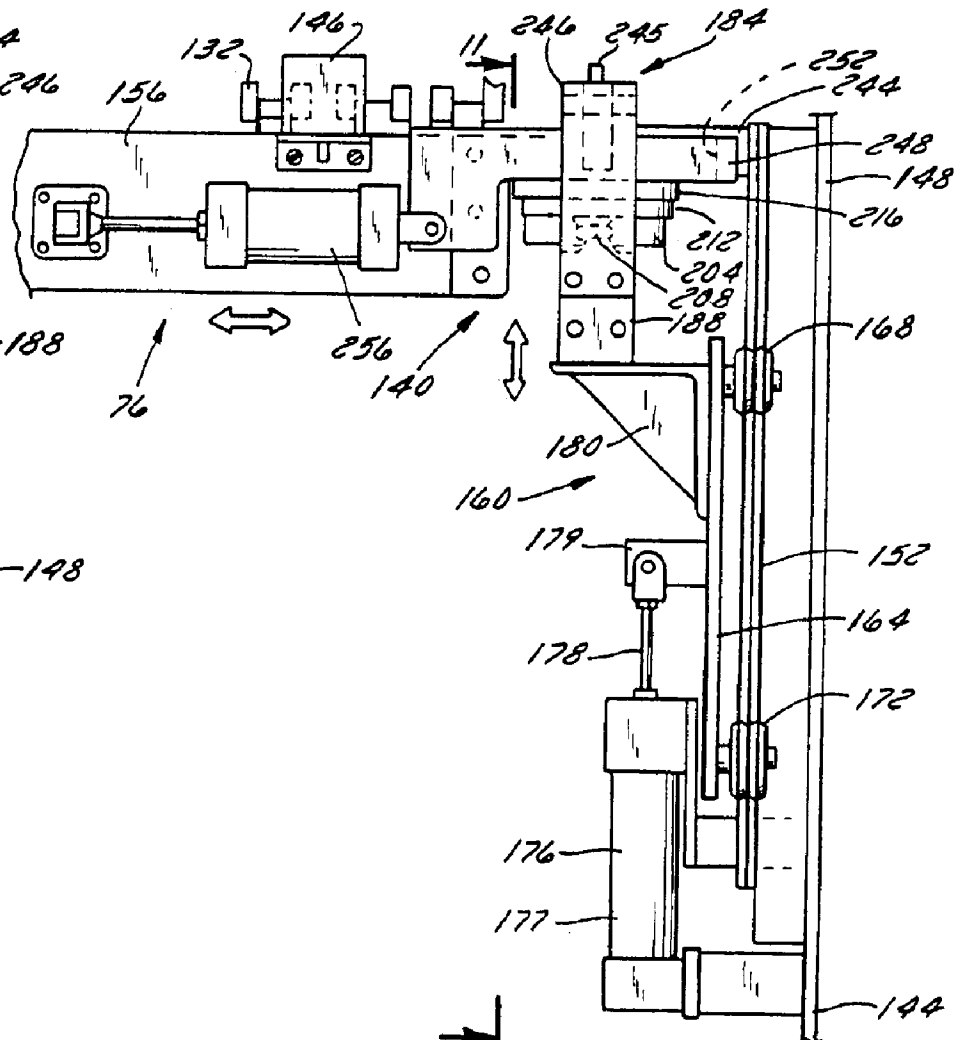
FIG. 10 is an enlarged front view showing the portion of the transfer station shown in FIG. 9.

The pusher carriage 140 includes a substantially horizontal pusher member 156 that supports the pusher arms 132. The horizontal pusher member 156 is supported between opposing vertical support assemblies 160 (only one is shown in FIG. 10). The support assemblies 160 are substantially mirror images of one another and only one will be described in detail. Each support assembly 160 includes a substantially vertical base plate 164 that supports a pair of upper rollers 168 and a pair of lower rollers 172 (only one roller of each pair is shown). The upper and lower rollers 168 and 172 engage the respective vertical guide rails 152 to guide the movement of the pusher carriage 140 in the vertical direction. Of course, other guiding arrangements, such as rack and pinion arrangements, bar and slider arrangements, and the like, could also be used.

A vertical actuator 176 is coupled between the base plate 164 and the frame support 148 to cause the vertical movement of the base plate 164 and the entire pusher carriage 140. In the illustrated embodiment, the vertical actuator 176 is a piston/cylinder actuator having a cylinder 177 fixed to the frame support 148 and a piston rod 178 fixed to the base plate 164 via a connection member 179. Of course, other mounting configurations and actuators could be used.

Figure 11:
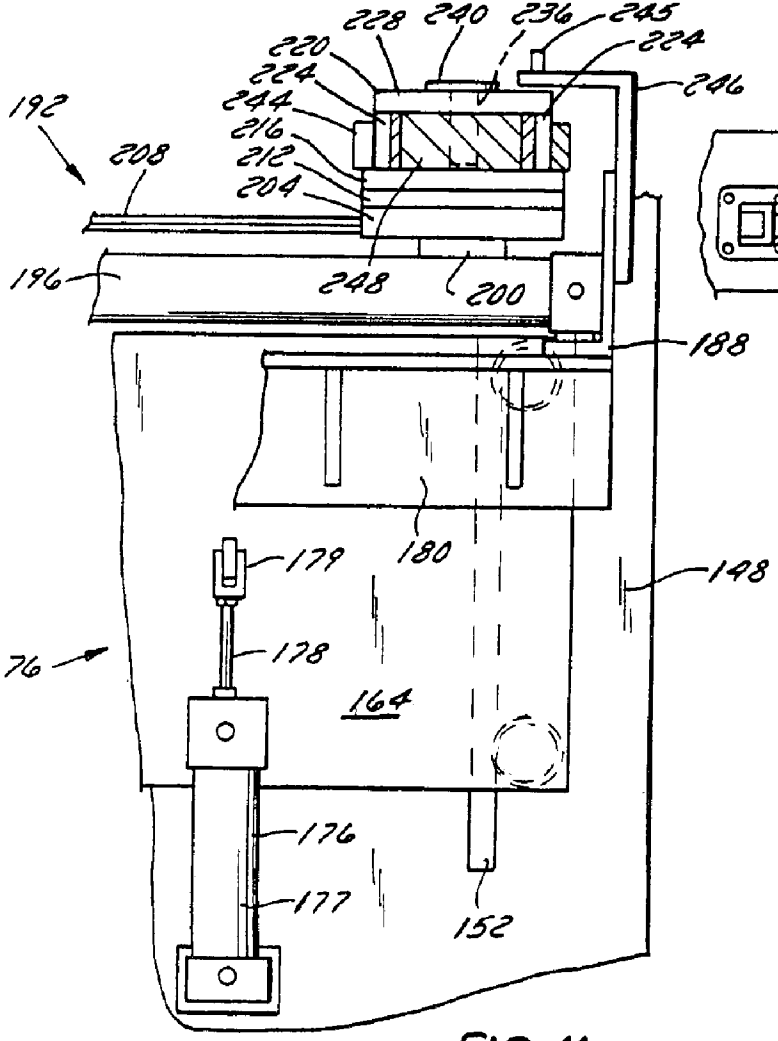
FIG. 11 is a section view taken along line 11—11 in FIG. 10.

Also mounted to the base plate 164 is an L-shaped support member 180 (see FIGS. 10 and 11). An arm of the support member 180 extends from the base plate 164 and supports a guide assembly 184 (see FIG. 10). The guide assembly 184 operates to guide the movement of the horizontal pusher member 156 in a longitudinal direction and in a lateral direction. For purposes of this description, the term "longitudinal direction" refers to a direction substantially parallel to the axis 128 and the direction of travel of the main conveyor 72, while the term "lateral direction" refers to a direction substantially perpendicular to the axis 128 and the direction of travel of the main conveyor 72.

As best seen in FIG. 11, the guide assembly 184 includes an L-shaped member 188 supported on the support member 180. A lateral actuator assembly 192 is mounted to the L-shaped member 188 for moving the pusher carriage 140 in the lateral direction. In the illustrated embodiment, the lateral actuator assembly 192 includes a rod-less air cylinder 196 that extends in the lateral direction. Rod-less air cylinders are known to those skilled in the art, and in the illustrated embodiment, the cylinder 196 includes a piston member 200 that protrudes from a slot (not shown) formed in the top of the cylinder 196. The slot extends in the lateral direction and is kept closed by a stainless steel band (not shown) that moves with the piston member 200 as the piston member 200 moves laterally. The piston member 200 is coupled to a guide plate 204 that moves laterally along a guide rail 208 as the piston member 200 moves in the cylinder 196. It should be noted that other types of actuators and actuator configurations can be substituted for the illustrated lateral actuator assembly 192.

The guide assembly 184 also includes a spacer plate 212 fixed to the guide plate 204 for movement therewith. More than one spacer plate 212 can be included to obtain the necessary vertical spacing from the guide plate 204. Mounted on the spacer plate 212 is a slide plate 216, which is made from a low-friction, wear-resistant material, preferably a plastic. The purpose of the slide plate 216 will be described below.

The guide assembly 184 further includes a U-shaped collar 220 mounted on the slide plate 216. The U-shaped collar 220 includes opposing vertical members 224 and a top member 228. The top member 228 includes an aperture 232 (see FIGS. 8 and 9) sized to receive a pin 236. A rigid strip 240 preferably covers the aperture 232 so that the pin 236 can not move upwardly out of the aperture 232. The purpose of the pin 236 will be described below.

A stop member 244 is mounted to one of the opposing vertical members 224 and cooperates with a sensor (not shown) to control the extent of lateral movement of the pusher carriage 140 toward the main conveyor 72. To control the extent of lateral movement away from the main conveyor 72, a sensor 245 cooperates with the top member 228 of the U-shaped collar 220. As best seen in FIG. 11, the sensor 245 is mounted on an L-shaped member 246, which is coupled to the L-shaped member 188.

As seen in FIGS. 8–11, the pusher member 156 includes opposing end portions 248 which are slidably received in the respective U-shaped collars 220. Each end portion 248 is sized to be slidably retained for movement in the longitudinal direction between the opposing vertical members 224. The end portion 248 is supported on its bottom side by the slide plate 216, which provides a reduced-friction, wear-resistant surface for facilitating the sliding of the end portion 248. In the illustrated embodiment, the end portions 248 are separate members that are coupled to the pusher member 156, however, the end portions 248 could alternatively be integral with the pusher member 156.

Each end portion 248 includes a slot 252 that receives the pin 236. The slot 252 and the pin 236 cooperate to limit the respective sliding movement between the end portion 248 and the U-shaped collars 220 to the longitudinal direction. The range of longitudinal sliding motion is limited by the length of the slot in the longitudinal direction. In the illustrated embodiment, the slot 252 is configured so that the end portions 248, and therefore the pusher member 156 and the gripper arms 132, can shift longitudinally one coil position (to the left or to the right as shown in FIGS. 8 and 9).

The longitudinal shifting of the pusher member 156 is actuated by a longitudinal actuator 256. In the illustrated embodiment, the longitudinal actuator 256 is a piston/cylinder actuator having a cylinder 260, a piston (not shown) inside the cylinder 260, and a rod 264 coupled to the piston and extending from the cylinder 260. The rod 264 is coupled to the pusher member 156 at a mounting member 268. The cylinder 260 is fixed to the U-shaped collar 220 via an L-shaped member 272. Therefore, when the actuator 256 is activated (either, pneumatically, hydraulically, or otherwise), the rod 264 extends or retracts with respect to the cylinder 260 and the U-shaped collar 220 to move the pusher member 156 longitudinally. Of course, other mounting configurations and actuators could be used.

Figure 9:
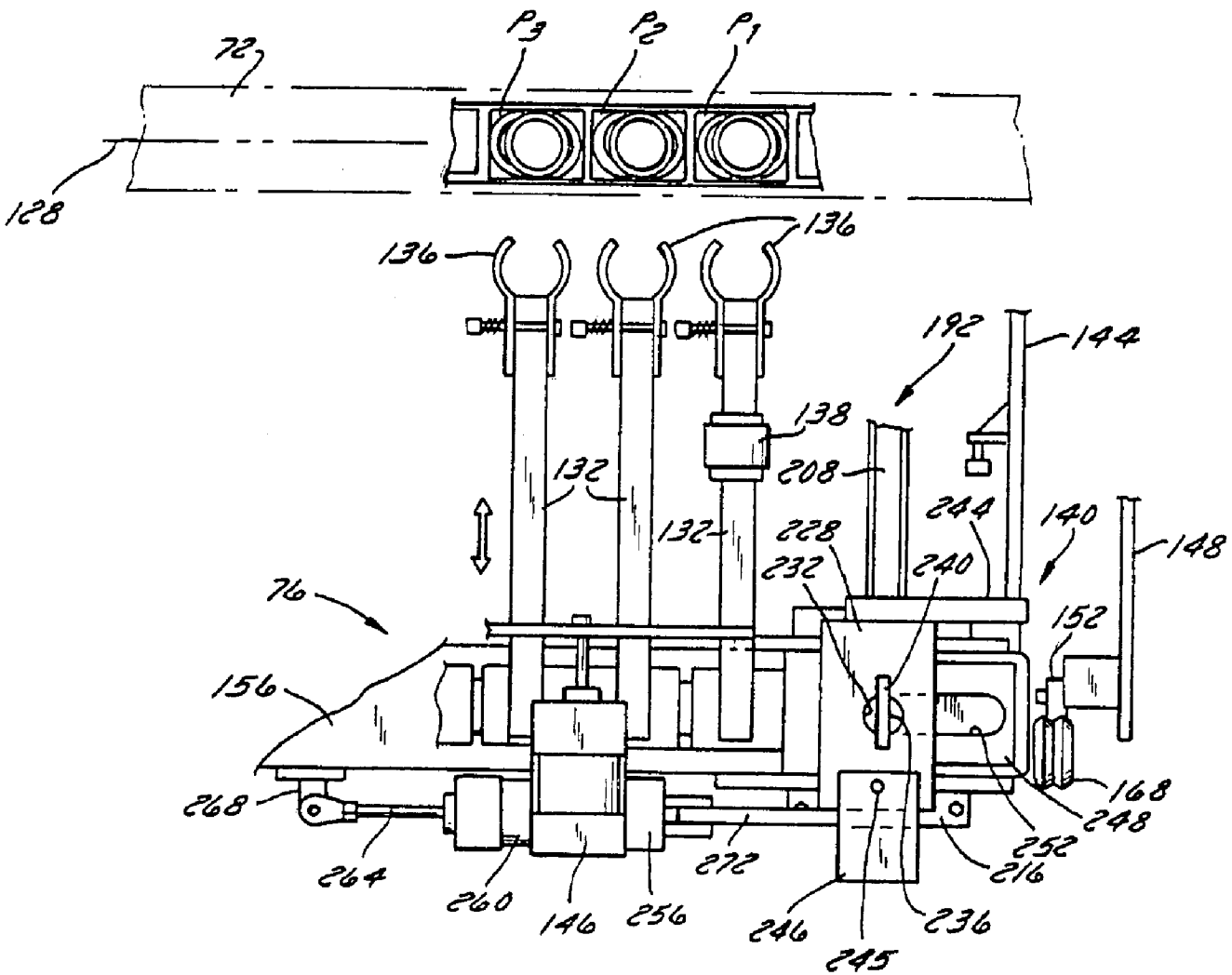
FIG. 9 is an enlarged top view showing a portion of the transfer apparatus shown in FIG. 8.

FIGS. 9 and 10 illustrate the pusher member 156 in one extreme longitudinal position. As seen in FIGS. 9 and 10, the pin 236 abuts the left-most side of the slot 252, meaning that the pusher member 156 is moved as far to the right as possible. This position will be called the "home" position for purposes of the discussion below. FIG. 8 illustrates the pusher member 156 in the other extreme longitudinal position. As seen in FIG. 8, the pins 236 abut the right-most side of the respective slots 252, meaning that the pusher member 156 is moved as far to the left as possible. This position will be called the "shifted" position for purposes of the discussion below. Notice that the rod 264 of the longitudinal actuator 256 is extended further in FIG. 8 than in FIGS. 9 and 10.

Operation of the transfer apparatus 76 will now be described. For the purpose of discussion only, it is assumed that the coils are placed on the main conveyor 72 so that a complete row R begins with a right-hand coil in a first position $P_1$ and ends with a right-hand coil in a last position $P_{17}$ (see FIGS. 8 and 9). Because the coils are placed on the main conveyor 72 in pairs, a position $P_{18}$ also exists, but is not used for a complete row R. If desired, a gap can exist at the position $P_{18}$ because that coil would not be used for the complete row R. Between the positions $P_1$ and $P_{18}$, the coils alternate between left-hand coils and right-hand coils, such that left-hand coils will be in positions $P_2$ and $P_{18}$. As described above, the alternating row of coils may include gaps where coils are intentionally absent.

With the pusher member 156 in the home position (as shown in FIG. 9) a first row R of coils is advanced along the main conveyor 72. The lateral actuator assemblies 192 are activated to move the pusher member 156 in the lateral direction toward the main conveyor 72 so the grippers 136 can grasp the coils. The gripper actuators 146 are activated, enabling the grippers 136 to grasp the coils. The right-most gripper 136 grasps the right-hand coil from the position $P_1$ and the left-most gripper 136 grasps the right-hand coil from the position $P_{17}$. The actuator 138 is then activated to rotate the coil picked up from position $P_1$ to enable proper assembly in the assembly apparatus 80. With the row R of coils held securely by the grippers 136, the pusher carriage 140 moves so that the grippers 136 can place the row R of coils in the assembly apparatus 80. The pusher carriage 140 is moved as needed by the vertical actuators 176 and the lateral actuator assemblies 192 until the row R of coils can be deposited in the assembly apparatus 80, as shown in FIG. 8. The pusher member 156 is then returned to the home position.

When making the spring coil assemblies 10 and 20, in which each column C consists entirely of either left-hand coils or right-hand coils, the operation of the transfer apparatus 76 is simply repeated as described above. The transfer apparatus 76 transfers each row R into the assembly apparatus 80 so that the first and last columns C1 and C17, respectively, will always consist of right-hand coils.

However, when making the spring coil assemblies 30, 40, and 50, in which the columns C consist of alternating left-hand and right-hand coils, the transfer apparatus 76 employs the longitudinal actuator 256 to move the pusher member 156 to the shifted position. This permits shifting the relative position of coils in adjacent rows R so that the position of right-hand and left-hand coils in adjacent rows are out of phase. As seen in FIG. 8, when the pusher member 156 is moved to the shifted position, the right-most gripper 136 will grasp the left-hand coil in position $P_2$ and the left-most gripper 136 will grasp the left-hand coil in position $P_{18}$. In FIG. 8, there is no coil on the main conveyor 72 at the position $P_1$ because the position $P_1$ is not being used for this shifted row R. The coil at position $P_1$ is intentionally left off of the main conveyor 72, as described above.

With the shifted row R of coils held securely by the grippers 136, the pusher carriage 140 moves so that the grippers 136 can place the shifted row R of coils in the assembly apparatus 80. The pusher carriage 140 is moved as needed by the vertical actuators 176, the lateral actuator assemblies 192, and the longitudinal actuator 256 until the shifted row R of coils can be deposited in the assembly apparatus 80, as shown in FIG. 8. The pusher member 156 is then returned to the home position. By shifting the pusher member 156 longitudinally during every other cycle, the transfer apparatus 76 delivers consecutive, phase-shifted rows of coils to the assembly apparatus 80, as required for forming the spring coil assemblies 30, 40, and 50.

The actuators 146, 176, 192 and 256 are preferably actuated by means of a numeric control or other similar programmable controller (not shown). The specific sequence of motion caused by the actuators 176, 192, and 256 is not critical to the invention as long as the grippers 136 can grasp the rows of coils from the main conveyor 72 and deposit the rows into the assembly apparatus 80 as needed to create the desired spring coil assemblies.

Various features of the invention are set forth in the following claims.

What is claimed is:

1. A method of manufacturing a spring coil assembly, the method comprising:

providing a coil forming machine having a wire feed advancing mechanism and being capable of forming coils in response to the advancement of wire by the wire feed advancing mechanism;

providing a main conveyor adapted to convey a plurality of coils along an axis; and selectively varying the advancement of wire by the wire feed advancing mechanism between a consistent advancement, wherein coils are formed and placed on the main conveyor in predetermined consistent intervals, and an inconsistent advancement, wherein coils are formed and placed on the main conveyor in predetermined inconsistent intervals.

2. The method of claim 1, further comprising:

selectively disregarding a signal from a sensor element that is intended to stop the manufacturing of the spring coil assembly when the coils on the main conveyor are spaced at inconsistent intervals.

3. The method of claim 1, further comprising:

selectively disabling a sensor element that produces a signal intended to stop the manufacturing of the spring coil assembly when the coils on the main conveyor are spaced at inconsistent intervals.

* * * * *